US009361746B2

(12) United States Patent
Otzen

(10) Patent No.: US 9,361,746 B2
(45) Date of Patent: Jun. 7, 2016

(54) AUTOMATIC CATERING MACHINE AND METHOD FOR OPERATING IT

(71) Applicant: MFL Suisse GmbH, Bern (CH)

(72) Inventor: Joerg Otzen, Le Mont-Pelerin (CH)

(73) Assignee: MFL Suisse GmbH, Bern (CH)

( * ) Notice: Subject to any disclaimer, the term of this patent is extended or adjusted under 35 U.S.C. 154(b) by 6 days.

(21) Appl. No.: 14/255,358

(22) Filed: Apr. 17, 2014

(65) Prior Publication Data

US 2014/0224826 A1 Aug. 14, 2014

Related U.S. Application Data

(63) Continuation of application No. PCT/EP2012/070431, filed on Oct. 15, 2012.

(30) Foreign Application Priority Data

Oct. 17, 2011 (DE) ..... 10 2011 084 634

(51) Int. Cl.
*G07F 9/10* (2006.01)
*G07F 11/10* (2006.01)
*G07F 11/16* (2006.01)

(52) U.S. Cl.
CPC ..... *G07F 9/105* (2013.01); *G07F 11/10* (2013.01); *G07F 11/165* (2013.01)

(58) Field of Classification Search
CPC ..... G07F 9/10; G07F 9/105; G07F 17/0064; G07F 17/0078
USPC ..... 221/150 R, 150 HC, 150 A
See application file for complete search history.

(56) References Cited

U.S. PATENT DOCUMENTS

| | | | | | |
|---|---|---|---|---|---|
| 5,168,795 | A * | 12/1992 | Okada | 99/326 |
| 5,245,150 | A * | 9/1993 | Grandi | 219/753 |
| 5,266,766 | A * | 11/1993 | Hecox | 219/680 |
| 5,564,594 | A * | 10/1996 | Monfredo | 221/150 A |
| 5,566,856 | A * | 10/1996 | Fallen et al. | 221/150 HC |
| 6,550,632 | B2 * | 4/2003 | Gubbini et al. | 221/13 |
| 8,651,324 | B2 * | 2/2014 | Borghi | 221/150 HC |
| 2004/0178213 | A1 * | 9/2004 | Martinelli et al. | 221/150 R |
| 2010/0169196 | A1 * | 7/2010 | De Luca | 705/34 |

FOREIGN PATENT DOCUMENTS

| | | | |
|---|---|---|---|
| DE | 34 12 899 | A1 | 10/1985 |
| DE | 297 21 628 | U1 | 3/1998 |
| DE | 600 30 942 | T2 | 8/2007 |
| FR | 2 681 217 | A1 | 3/1993 |
| GB | 2 209 332 | A | 5/1989 |
| GB | 2 267 700 | A | 12/1993 |
| WO | WO 98/25240 | A2 | 6/1998 |
| WO | WO 2010/130670 | A1 | 11/2010 |

* cited by examiner

*Primary Examiner* — Patrick Mackey
(74) *Attorney, Agent, or Firm* — Muncy, Geissler, Olds & Lowe, P.C.

(57) ABSTRACT

An automatic catering machine in which at least one item of food can be stored, cooled and/or heated. The automatic catering machine has a rack store for storing a large number of items of food and a transportation apparatus by means of which in each case at least one item of food can be removed from the rack store and transported to at least one station in the automatic catering machine, wherein the transportation apparatus has a transportation tool for grasping the item of food, which transportation tool can be moved horizontally and vertically. A method for operating the automatic catering machine is also provided.

15 Claims, 11 Drawing Sheets

AUTOMATIC CATERING MACHINE AND METHOD FOR OPERATING IT

This nonprovisional application is a continuation of International Application No. PCT/EP2012/070431, which was filed on Oct. 15, 2012, and which claims priority to German Patent Application No. DE 10 2011 084 634.4, which was filed in Germany on Oct. 17, 2011, and which are both herein incorporated by reference.

BACKGROUND OF THE INVENTION

1. Field of the Invention

The present invention relates to a vending machine and a method for operating a vending machine.

2. Description of the Background Art

Vending machines may be used both for storing food products and for preparing food products; i.e., once they have been fully automatically or semi-automatically filled with food products, the vending machines may heat the food products (using a wide range of methods, such as microwave, convection heat, contact heat) and/or cool them and/or also only store them and subsequently dispense them to the operator/consumer.

A vending machine for dispensing hot food is known from DE 600 30 942 T2, which corresponds to U.S. Pat. No. 6,550,632. The vending machine includes a housing, which is divided into a cooled section and a heating section, which are separated from each other and are connected to each other. The cooled section includes a storage unit, which is designed to contain a plurality of foods, each of which is packaged in an appropriate, sealed container. The cooled section also includes a pickup device for removing one particular food item from the storage unit by peripherally gripping the associated container, an opening device for opening the container and transfer device for removing the food from the container. The heating section includes a heating unit, a magazine of stacked, disposable containers, movable supporting device, which are designed to receive the food from the transfer device and which transfer it to the heating section and introduce it into the heating unit and then deliver the hot food to one of the containers, a delivery device for transferring the food in the associated container outside the housing and motorized driving device and control device, which may be activated from outside the housing and which are provided for synchronous control of the pickup device, the opening device, the transfer device, the movable supporting device and the delivery device according to a predetermined automatic cycle. The food comprises precooked pizzas. The heating unit is an electric oven. The containers have trays. The magazine of disposable trays is located in a position below the electric oven and contains a movable opposing device which interacts with the supporting device to deposit the hot pizza on the top tray within the vending machine. A supporting base carries a stack of disposable trays and may be raised so as to position the top of the stack of disposable trays directly beneath the movable opposing device. The delivery device includes a pushing/separating assembly, which is movable over the top of the magazine of stacked trays, using alternating movements in a straight line, in a position corresponding to a dispensing outlet of the housing for the purpose of transferring the hot pizza, which is delivered on the tray located on the top of the magazine, to the dispensing outlet.

A device for accommodating a plurality of recorded audio and video carriers is described in DE 297 21 628 U 1. The device includes a holding device for individual cassettes, a controllable cassette removal device which may be moved to the individual cassettes, an ejection device and a card-controlled and/or key-controlled preselection and registration device. The ejection device is simultaneously designed as an insertion device for cassettes. The holding device has holding elements which are disposed on multiple levels located above each other vertically on the inner walls of a free-standing, circular structure. The cassette removal device is disposed in the center of the structure and has a transport unit which is movable vertically on a rail and which transports each cassette from and to its proper location.

A food vending machine is known from DE 34 12 899 A1. The food vending machine is provided with a magazine for a plurality of cooled or uncooled, apportioned food items, a heating device, a dispensing station, a transport device operating between the magazine and heating device and a selection station. The magazine is disposed in a storage cabinet, which is divided into at least one cooling compartment and at least one freezer compartment, bowls of food being exchangeable between the cooling compartment and the freezer compartment with the aid of the transport device.

A microwave oven and an automatic dispensing device for food products, including a microwave oven of this type, is described in FR 2 681 217 A1. The interior of the oven is accessible through a tight-sealing door. The door has a pickup device for picking up the products to be heated, and it is movable between a first position, in which the pickup device is to be loaded with the products to be heated, and a second position, in which the pickup device having the products to be heated are situated in the interior of the microwave oven. While returning to the first position, the pickup device interacts with dispenser. The device comprises a rack storage compartment for storing a plurality of food products and a pusher, with the aid of which one particular food product may be pushed out of the rack storage compartment. The pusher is movable horizontally and vertically and surrounded by the rack storage compartment.

A vending machine for dispensing hot food is known from GB 2 267 700 A. The vending machine comprises a compartment for storing sealed food containers, a microwave oven and a device for transporting a food container from a storage chamber to the microwave oven for heating the food in the food container before it is dispensed. To prevent the food container from bursting in the microwave oven, a sealing film is punctured with the aide of a heating element before the food container is placed in the microwave oven. Heating the heating element ensures that it remains sterile.

SUMMARY OF THE INVENTION

It is therefore an object of the present invention to provide an improved vending machine and a method for its operation.

At least one food product may be stored, cooled and/or heated in a vending machine according to the invention.

In an embodiment, the vending machine has a rack storage compartment for storing a plurality of food products and a transport device with the aid of which at least one particular food product may be removed from the rack storage compartment, the transport device having a transport tool for gripping the food product, which is movable at least horizontally and vertically and is rotatable and/or pivotable at least around a vertical axis. The transport device is at least partially surrounded by the rack storage compartment. The food product may be transported with the aid of the transport tool of the transport device to a plurality of stations in the vending machine, which are situated above the rack storage compartment.

In the method according to an embodiment of the invention for operating this vending machine, at least one food product is removed from the rack storage compartment for storing a plurality of food product with the aid of the transport device, which is at least partially surrounded by the rack storage compartment, and transported to a plurality of stations in the vending machine, the transport tool of the transport device being moved at least horizontally and vertically and rotated and/or pivoted at least around a vertical axis for the purpose of approaching a storage position of the food product and gripping and transporting the food product.

With the aid of the transport tool, a food product desired by a consumer is to be removed from the rack storage compartment in this manner and transported to the stations for preparation and/or dispensing. The stations may have different devices for preparing, storing and/or dispensing the food product to the consumer.

Transporting the food product from the rack storage compartment to the plurality of stations with the aid of the transport tool facilitates a fully automatic storage, preparation and/or dispensing of the food product to the consumer. Moreover, this approach facilitates a so-called dynamic stocking of the food product in the rack storage compartment, which is also known as random stocking. In other words, a large number of different food products are to be sorted into random storage positions in the rack storage compartment, it being necessary to uniquely identify and store the particular food product and its storage position in the rack storage compartment. When the consumer makes a corresponding selection of the food product, the latter is to be removed from the rack storage compartment with the aid of the transport tool, which approaches its storage position in the rack storage compartment, and transport it to the station in the vending machine.

The food product may be sorted into the rack storage compartment, for example, manually or automatically or at least semi-automatically, it being necessary to identify and store each food product and its storage position in the rack storage compartment. Automatic or semi-automatic sorting may take place, for example, with the aid of the transport tool, which automatically picks up the food product to be stored in the rack storage compartment at a station in the vending machine and stocks it in the rack storage compartment.

This dynamic or random storage of food products avoids, in particular, incorrect filling of the rack storage compartment, since it is not necessary to sort different types of food products into permanently reserved storage positions for the particular type. In a fixed-position storage approach of this type, incorrectly sorted food products could result in an incorrect food product not selected by the consumer to be dispensed. This is prevented by the dynamic or random stocking.

Moreover, since it is necessary to identify the stocked food products, it is possible to easily monitor the inventory. This enables the rack storage compartment to be refilled in good time when one or multiple types of food products is/are reduced, so that an availability of the food products may be easily optimized. A quantity of different food products must also be adapted adjusted to their particular demand, since no fixed storage locations are necessary for different food products. In other words, different types of food products are to be stocked in different quantities, depending on their demand, so that an existing storage location in the rack storage compartment is to be optimally used, whereby intervals between refilling the rack storage compartment may be prolonged, and the rack storage compartment and thus the vending machine may have a smaller design.

Due to the fact that the transport tool is rotatable and/or pivotable at least around a vertical axis, all food products stored in the rack storage compartment are accessible with the aid of the transport tool and removable from the rack storage compartment solely by controlling the movement of the transport tool. An additional movement of the rack storage compartment, for which purpose an additional drive of the rack storage compartment and also its controller would be required, is therefore unnecessary. In other words, transporting the food products and thereby fully automatically preparing them and dispensing them to the consumer are implemented easily, cost-effectively and in a space-saving manner.

In another embodiment, however, the rack storage compartment may additionally be rotatably supported. In this manner, a manual filling of the rack storage compartment with food products, for example, is facilitated, it being necessary, for example to open a door on the side of the vending machine and to successively fill the rack storage compartment. All storage locations may be easy reached by rotating the rack storage compartment. The vending machine may furthermore also have a drive for rotating the rack storage compartment, so that, to remove a particular food product, the rack storage compartment must also be rotated into a position in which the food product is to be reached by the transport tool and removed from the rack storage compartment by correspondingly activating this drive. Due to the rotatable rack storage compartment, the vending machine is consistent with a revolver principle.

In the method for operating the vending machine, according to the particular embodiment of the vending machine, the transport tool is rotated and/or pivoted at least around a vertical axis, and/or the rack storage compartment is rotated around a vertical rotation axis, to approach a storage position of the food product with the aid of the transport tool and to grip and transport the food product.

The drive or a plurality of drives of the transport device and/or the rack storage compartment may be designed, for example, as an electric motor, in particular a servomotor, or also have a pneumatic or hydraulic design, and be coupled to the transport device and/or the rack storage compartment, directly or via gears, for example via belt or chain drives or via toothed gears.

The rack storage compartment can have storage locations for food products on a plurality of levels disposed above each other, the storage locations on each level together forming a circle. In other words, the storage locations of the rack storage compartment are disposed side by side in a circular configuration on multiple rows, i.e., on multiple levels above each other, and in multiple columns, so that the rack storage compartment has a circular contour. This is a very efficient arrangement of food products, especially suitable for automatically transporting the food products from the rack storage compartment with the aid of the transport device, since all food products stocked in the rack storage compartment are accessible and removable from the rack storage compartment by rotating or pivoting the transport tool and/or by rotating the rack storage compartment as well as due to horizontal and vertical movements of the transport tool, the transport tool being able to remove the food product stored at the particular storage position by approaching the corresponding row and column of the rack storage compartment.

In such a design of the rack storage compartment, the transport device is at least partially surrounded by the rack storage compartment, since sufficient space for disposing the transport device is available in the vertical middle region of the rack storage compartment, i.e., in the region of a rotation axis of the rack storage compartment, and, due to such an arrangement of the transport device, all food products stocked in the rack storage compartment may also be reached and removed from the rack storage compartment solely due to corresponding movements of the transport device. Due to such an essentially central arrangement of the transport device in the vending machine, all stations of the vending machine where the food product is to be prepared, temporarily stored and/or dispensed to the consumer may also be reached with the aid of the transport tool.

In an embodiment, the transport device is disposed on an outside of the rack storage compartment. In this case, the rack storage compartment is to be automatically rotated in addition to the transport device, with the aid of a corresponding drive, for the purpose of reaching all storage position of the rack storage compartment with the aid of the transport tool. Alternatively, the transport tool is moved around the circumference of the rack storage compartment, along an outside of the rack storage compartment. In this manner, no rotational movement of the rack storage compartment is required. However, this would require more installation space on an outside of the rack storage compartment for moving the transport tool.

A vertical linkage of the transport device, on which the transport tool is disposed and along which it is movable vertically, is preferably at least partially surrounded by the rack storage compartment in such a way that the linkage is centrically or eccentrically disposed in the rack storage compartment. A centric arrangement requires more installation space to enable the transport tool to freely rotate, i.e., at least twice the length of a non-vertically extended transport tool. It must then be moved to the particular storage position by rotating and by a vertical movement, and the particular food product must be picked up and removed from its storage position by a horizontal movement. However, these greater installation space requirements are insignificant in a large rack storage compartment containing a large number of food products on one particular level, since a diameter of the storage levels is increased in this case to be able to situate all food products. A sufficient installation space is thus available in the middle region surrounded by the rack storage compartment.

To create the smallest possible vending machine, which has the least amount of installation space, in particular the smallest possible footprint, and in which a smaller rack storage compartment having a few storage position is sufficient, the eccentric arrangement of the linkage of the transport device is particularly useful, so that the linkage is disposed directly adjacent to an inner edge of the rack storage compartment. In this manner, a free installation space for the transport device in the interior of the rack storage compartment is sufficient, which equals or is only slightly greater than the length of the non-vertically extended transport tool. In this arrangement, the transport tool is also freely rotatable or pivotable and vertically movable in the rack storage compartment for the purpose of approaching a particular storage position. By horizontally moving the transport tool, the particular food product may then be picked up and removed from the rack storage compartment.

The vending machine can include a grill for at least partially preparing the food product, the grill having at least one resistance wire heating device, in which one or multiple resistance wire(s) is/are disposed in an unenclosed manner. In other words, it is not a so-called quartz grill, in which the heating wires are enclosed by quartz glass and surrounded by gas. This design of the grill, which has at least one resistance wire heating device, permits an emission of thermal radiation, in particular infrared radiation, having a greater wavelength than in a quartz grill. The wavelength of the radiation in this grill having resistance wires is, for example, approximately 2.8 μm to 3.8 μm, while it is approximately 1.1 μm in a quartz grill. The greater wavelength makes it possible to prepare the food product, i.e., to heat it, even in the packaged state, since longer-wave radiation penetrates the packaging and acts upon the food product. With the aid of a grill having resistance wires, which are disposed, for example, over a wide area and evenly on the grill and cover an area corresponding to an extension of the food product, a much more directed radiation emission is also possible than in a quartz grill, in which the radiation emission from the quartz glass tubes takes place in all directions.

Alternatively or additionally, the vending machine may have additional devices for at least partially preparing the food product, in particular a microwave.

The vending machine can include a perforation unit for introducing at least one hole into a package of the food product prior to its preparation. The perforation unit has, for example, one or more needle-like elements, which are disposed in an upper area of the vending machine and are oriented downwards, so that while the food product is being lifted out of the rack storage compartment with the aid of the transport tool, the packaging is to be perforated by being lifted in the direction of the perforation unit and then lowered slightly and transported for further processing. Due to this perforation, it is possible for fluids, in particular steam, to escape from the packaging while the food product is being heated, and the destruction of the packaged due to too much internal pressure is prevented. In this manner, it is not necessary to open the packaging all the way to prepare the food product, so that the latter remains hygienically packaged. However, the vending machine may also alternatively have an opening mechanism for opening the packaging, possibly for removing the food product from the packaging for the purpose of preparing and repackaging the food product. However, this would be associated with increased complexity.

A cooling device can be disposed on an upper side of the rack storage compartment. The food products may be cooled with the aid of this cooling device and thereby stored for a much longer period of time. By disposing the cooling device on the upper side of the rack storage compartment, cooling is particularly efficient, since air cooled with the aid of the cooling device drops in the direction of the rack storage compartment, whereby the rack storage compartment is placed in a pool of cold air generated by the cooling device. The cooling device is designed and disposed in such a way that the food products are transported with the aid of the transport device past the cooling device and out of the rack storage compartment to the individual stations of the vending machine. In other embodiments of the vending machine, however, the cooling device may be disposed in a different position, for example it may be at least partially surrounded by the rack storage compartment, or it may at least partially surround the rack storage compartment, for example on the side, or it may be disposed on a lower side of the rack storage compartment.

The vending machine can include at least one identification device for identifying the food product. In one preferred embodiment, this identification device is a reader for reading a transponder on the food product or on its packaging. This transponder is, for example, a so-called RFID (radio frequency identification) chip.

In another embodiment, the identification device is an optical recording unit, for example a camera or a bar code reader. It is also possible to use multiple identification devices, for example to ensure a reliable identification of the food product at any time. In this manner, food products which may be identified in different ways, i.e., for example if they do not have a bar code or a transponder, may be processed by this vending machine.

As a result, the food product may be easily identified and handled by the vending machine on the basis of the transponder or on the basis of a bar code on the packaging or on the basis of the packaging itself or its label, i.e., for example prepared at a temperature adapted to the particular food product and cooking time in the grill and/or the microwave, and/or cooled and/or stored at an appropriately adjusted temperature. An item of transponder information or the label on the packaging, for example the bar code, may furthermore contain, for example a sell-by date for the food product, so that a flawless condition of the food product to be dispensed to the consumer is ensured at all times.

By using multiple identification devices designed as cameras at different positions in the vending machine, it is furthermore possible, for example to check and monitor an optimum positioning of the food product in the rack storage compartment and/or on the transport tool and/or a particular condition of the food product. For example, it is possible to assess a current cooked status of the food product with the aid of a camera in the region of the grill and/or the microwave. A camera in the rack storage compartment may be used to monitor the stock therein and assess the state of its quality.

The vending machine can include at least one touch-sensitive display unit. The latter gives the consumer an easy and comfortable means of communication between the consumer and the vending machine. With the aid of the touch-sensitive display unit, for example, the food product is selectable by the consumer, and a time remaining until the food product is finished and dispensed may be displayed to the consumer by the vending machine. For example, the vending machine may furthermore be programmed via this touch-sensitive display unit, i.e., for example, food products to be processed may be specified, and storage times and/or temperatures as well as preparation times and/or temperatures may be assigned to them.

In one embodiment, the vending machine preferably has at least one payment unit, which enables the consumer to pay for the food product, These are, for example a cash payment unit and/or a payment unit for debit and/or credit cards.

In another embodiment, the vending machine has at least one wired and/or wireless communication unit. This communication unit makes it possible, for example, to check a particular means of payment, for example the prepaid card or credit card of the consumer, to ensure the consumer's ability to pay. A communication unit of this type furthermore facilitates a remote data transmission for maintenance and control of the vending machine, so that, for example, malfunctions may be identified immediately and possibly corrected with the aid of remote data transmission. It is also possible, for example, to check a current fill state of the storage container in this manner, so that it may be refilled in good time.

A remote ordering of food products with the aid of remote data transmission is furthermore facilitated by this communication unit, so that the consumer may select and order a food product from a greater distance, for example from home, which may then be prepared by the vending machine while the consumer makes his way to the vending machine to pick up the food product. Long waiting times for the consumer at the vending machine while the ordered food product is being prepared are prevented in this manner. For example, the consumer may also be notified, via this communication unit, of when his food product is finished and ready for dispensing, so that he can pick it up on time. If the consumer is late in picking up the food product, the latter may be temporarily stored and kept warm in one of the stations of the vending machine.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

FIGS. 1 through 12 show representations of one advantageous embodiment of a vending machine 1 as well as components or component groups of vending machine 1 in different views.

Figure 1:
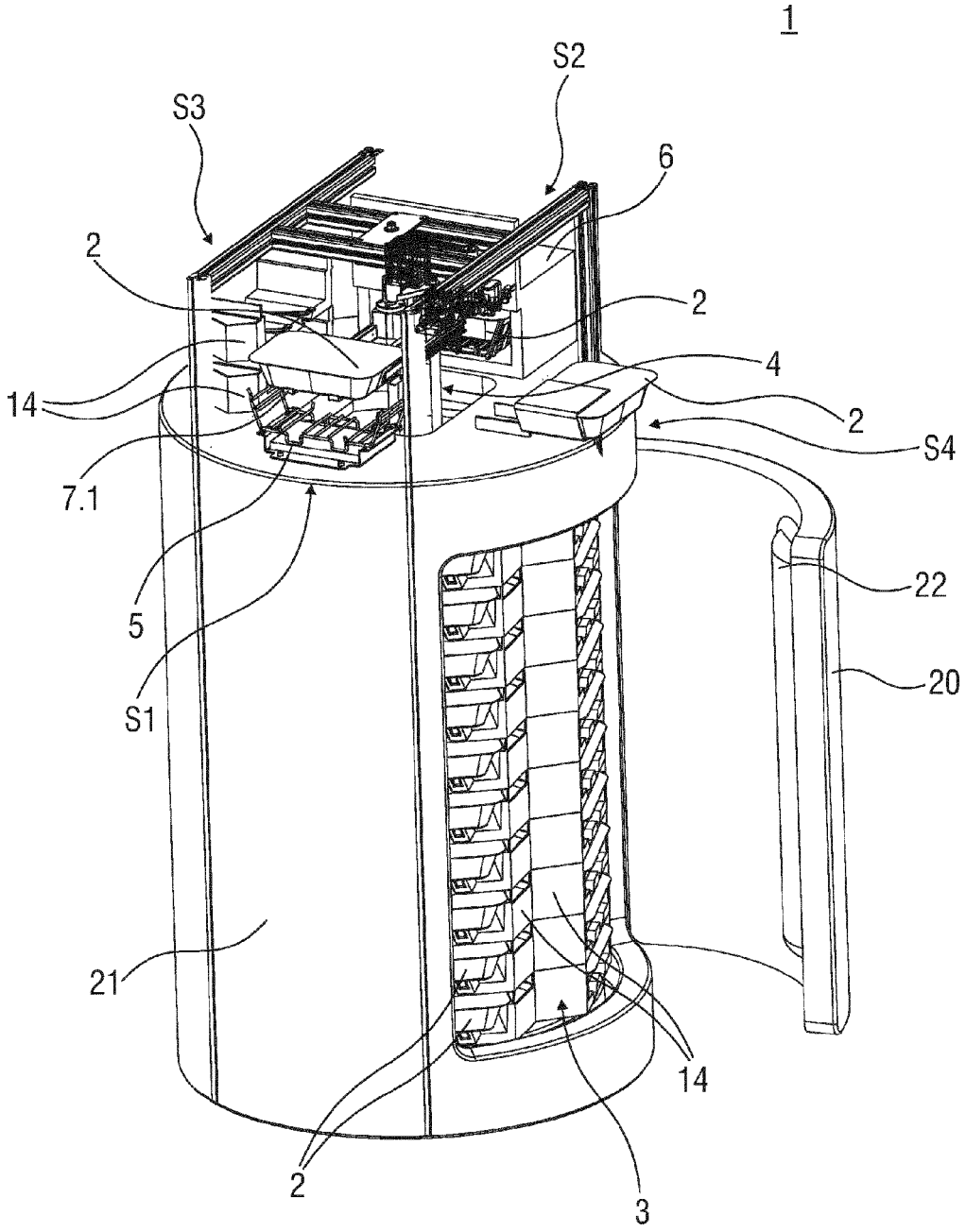
FIG. 1 schematically shows a perspective representation of a vending machine.

Food products 2 may be stored, cooled and heating in a vending machine 1 of this type. For storing food products 2, vending machine 1 has a rack storage compartment 3, from which one particular food product 2 may be removed with the aid of a transport device 4 and transported to one or multiple stations S1, S2, S3, S4, four in the example illustrated herein, in vending machine 1. As illustrated in FIG. 1, stations S1, S2, S3, S4 are disposed above rack storage compartment 3, vending machine 1 having an outer casing surrounding stations S1, S2, S3, S4, which is not illustrated herein for the sake of clarity.

The embodiment of vending machine 1 illustrated herein has a grill 5 at a first station S1 and a microwave 6 at a second station S2, by means of which particular food product 2 may be heated, i.e., food product 2 may be prepared with the aid of microwave 6 and/or with the aid of grill 5, or the preparation may be at least finished with the aid of microwave 6 and/or with the aid of grill 5. Generally known and used term, microwave 6, is understood to be a microwave irradiation device for heating food products 2.

Depending on the type of particular food product 2 and its preparation requirements, for example only microwave 6 or only grill 5 or a combination of microwave 6 and grill 5 may be used to prepare food product 2, in which case a sequence of use is dependent on the type of food product 2 and its preparation requirements.

Food products 2 may be temporarily stored at a third station S3 of vending machine 1 before and/or after they are prepared and/or in an intermediate step during preparation. To be able to temporarily store food products 2 in this third station S3, in particular after they are prepared, for example if a consumer to whom particular food product 2 is to be dispensed has not yet arrived at vending machine 1 to receive food product 2, third station S3 advantageously has a warming device, which is not illustrated in greater detail herein. A fourth station S4 of vending machine 1 is designed to dispense food product 2 to the consumer.

Figure 2:
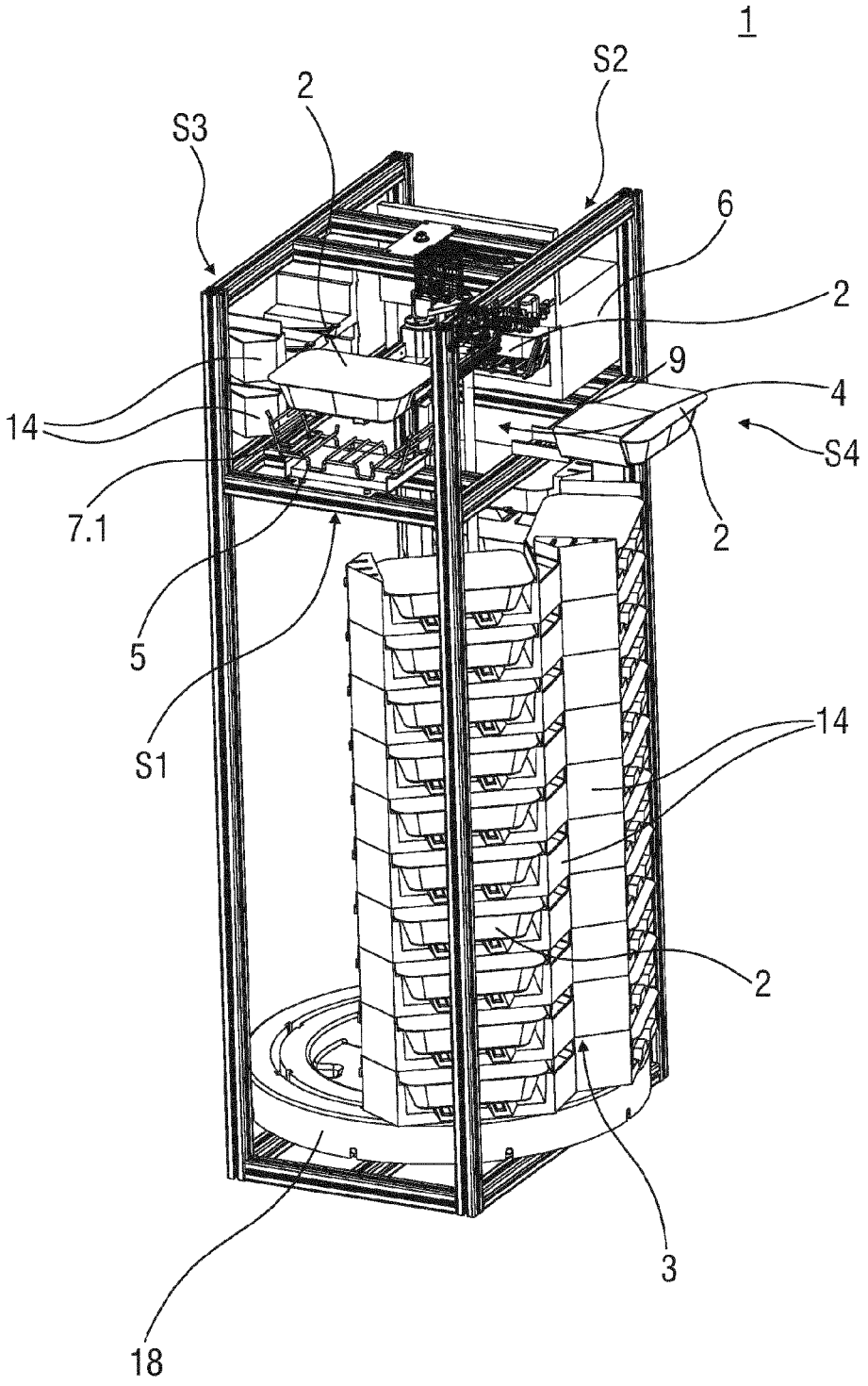
FIG. 2 schematically shows a perspective representation of an interior of a vending machine.
Figure 3:
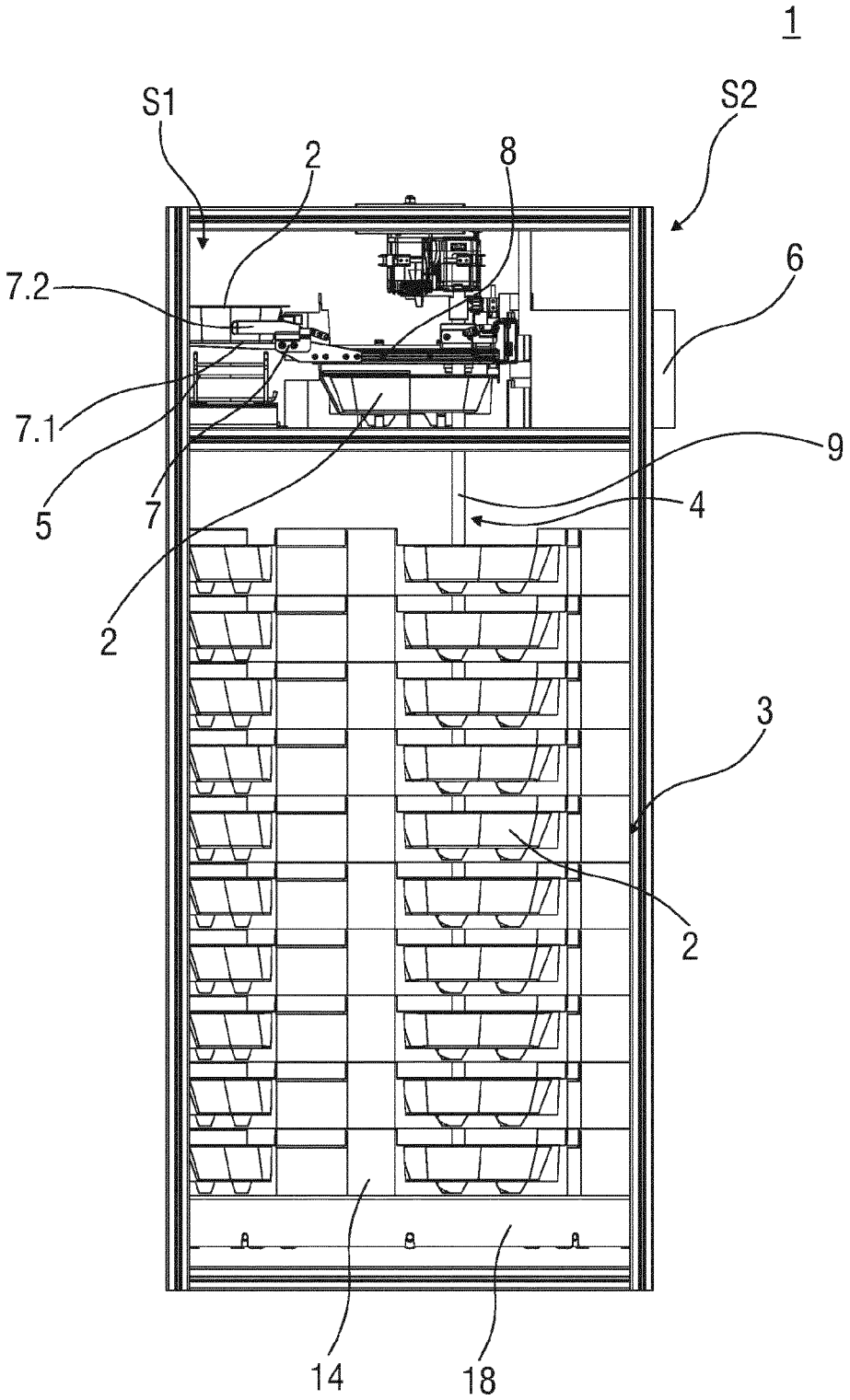
FIG. 3 schematically shows a side view of an interior of a vending machine.

As illustrated, for example, in FIGS. 1 and 2, food products 2 may be located in different or in all stations S1, S2, S3, S4 at the same time, i.e., a food product 2 may be transported from one of stations S1, S2, S3, S4 to another, for example with the aid of transport device 4, in order, for example, to further prepare them, and subsequently to transport another food product 2 from rack storage compartment 3 to one of stations S1, S2, S3, S4, for example to already begin its preparation and to subsequently dispense fully prepared food product 2 to the consumer at fourth station S4 or to temporarily store it in third station S3. In other words, it is not necessary to wait until one food product 2 is fully processed and dispensed to the consumer before retrieving a subsequent food product 2 from rack storage compartment 3. In this manner, processing multiple food products 2 at the same time in different stations S1, S2, S3, S4 makes it possible to quickly fill consumer requests even if there is a large number of consumers.

In one embodiment, which is not illustrated, vending machine 1 may furthermore have an additional transport device for transporting food products 2 from one of stations S1, S2, S3, S4 to one or multiple other stations S1, S2, S3, S4, so that food product 2 may be only removed from rack storage compartment 3 with the aid of transport device 4 and transported to this additional transport device, which is designed, for example, as a turntable. A turntable of this type may also have openings or be designed as a plurality of fork tines disposed in a circular configuration, to facilitate the irradiation of food product 2 from below, for example in grill 5.

Figure 4:
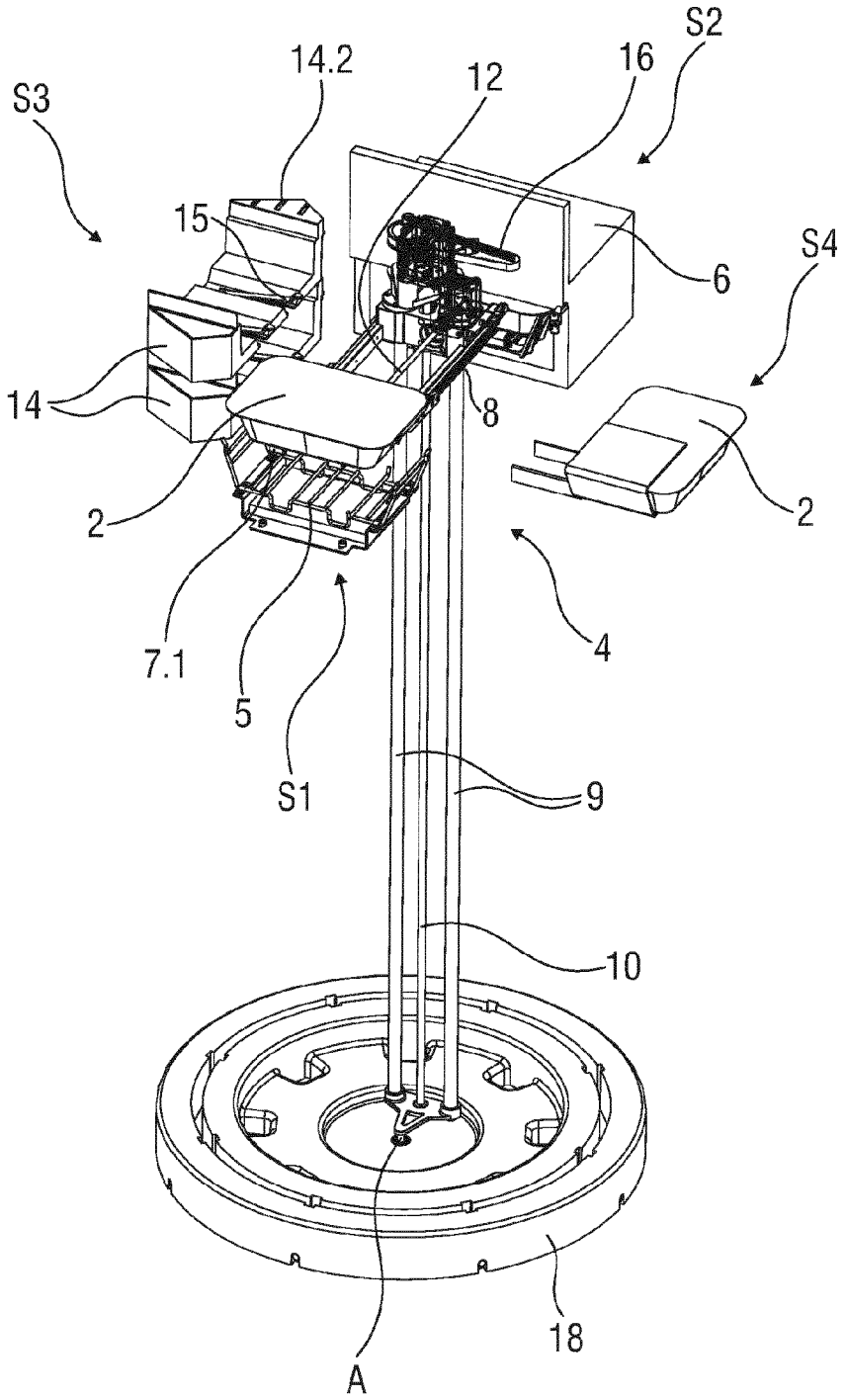
FIG. 4 schematically shows a perspective representation of internal components of a vending machine.
Figure 5:
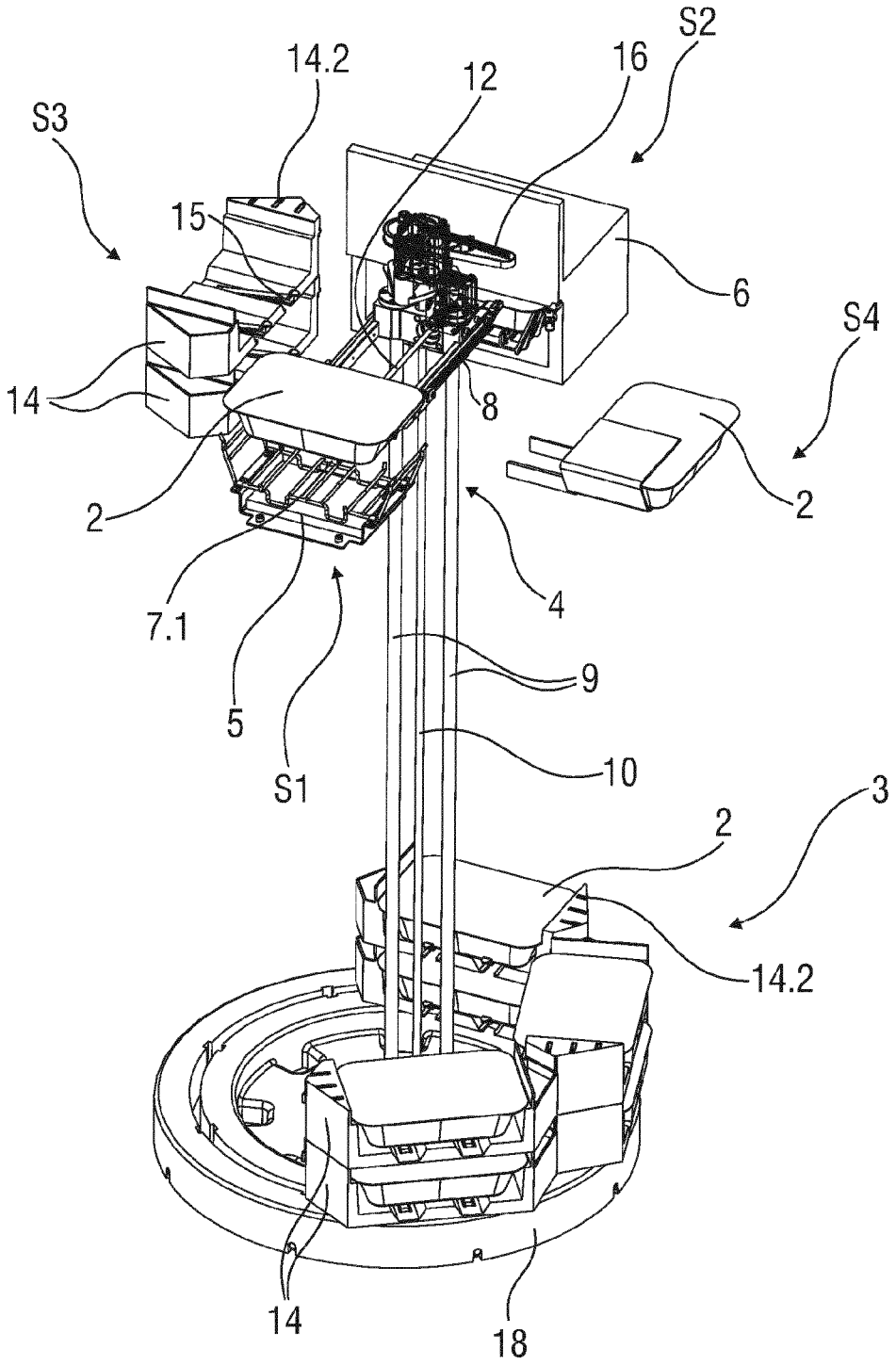
FIG. 5 schematically shows another perspective representation of internal components of a vending machine.
Figure 9:
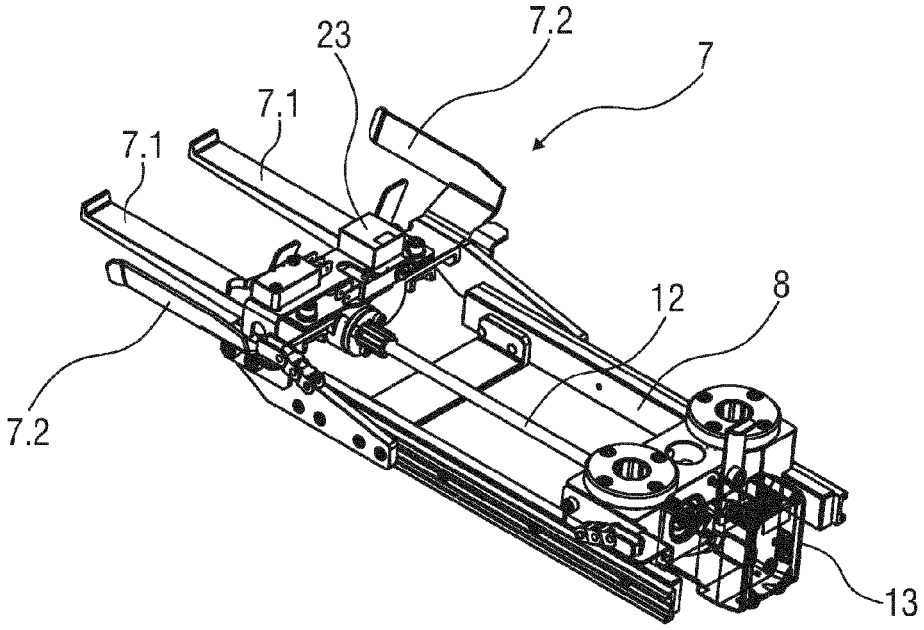
FIG. 9 schematically shows a perspective representation of a transport tool of a vending machine.
Figure 10:
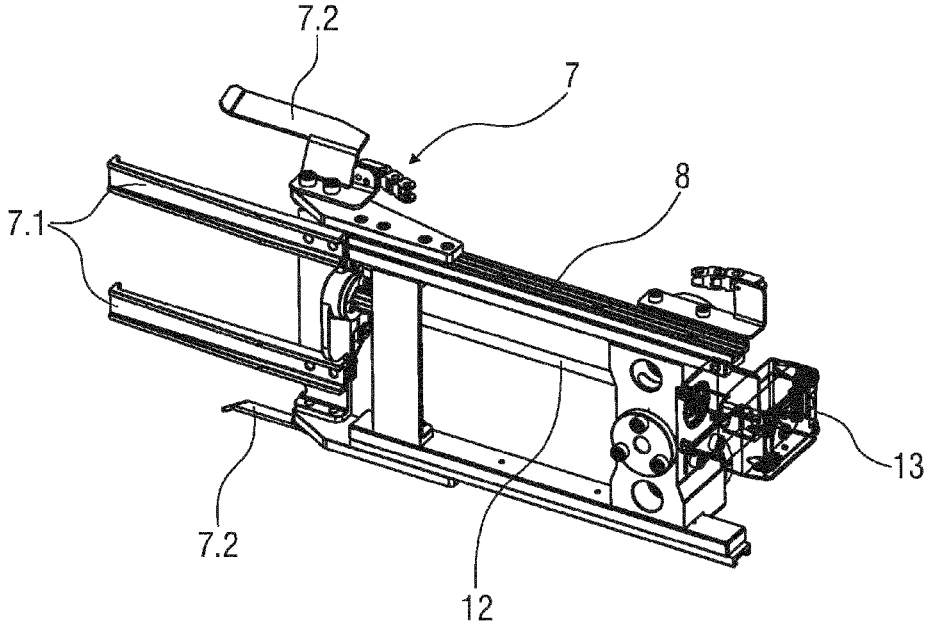
FIG. 10 schematically shows another perspective representation of a transport tool of a vending machine.
Figure 11:
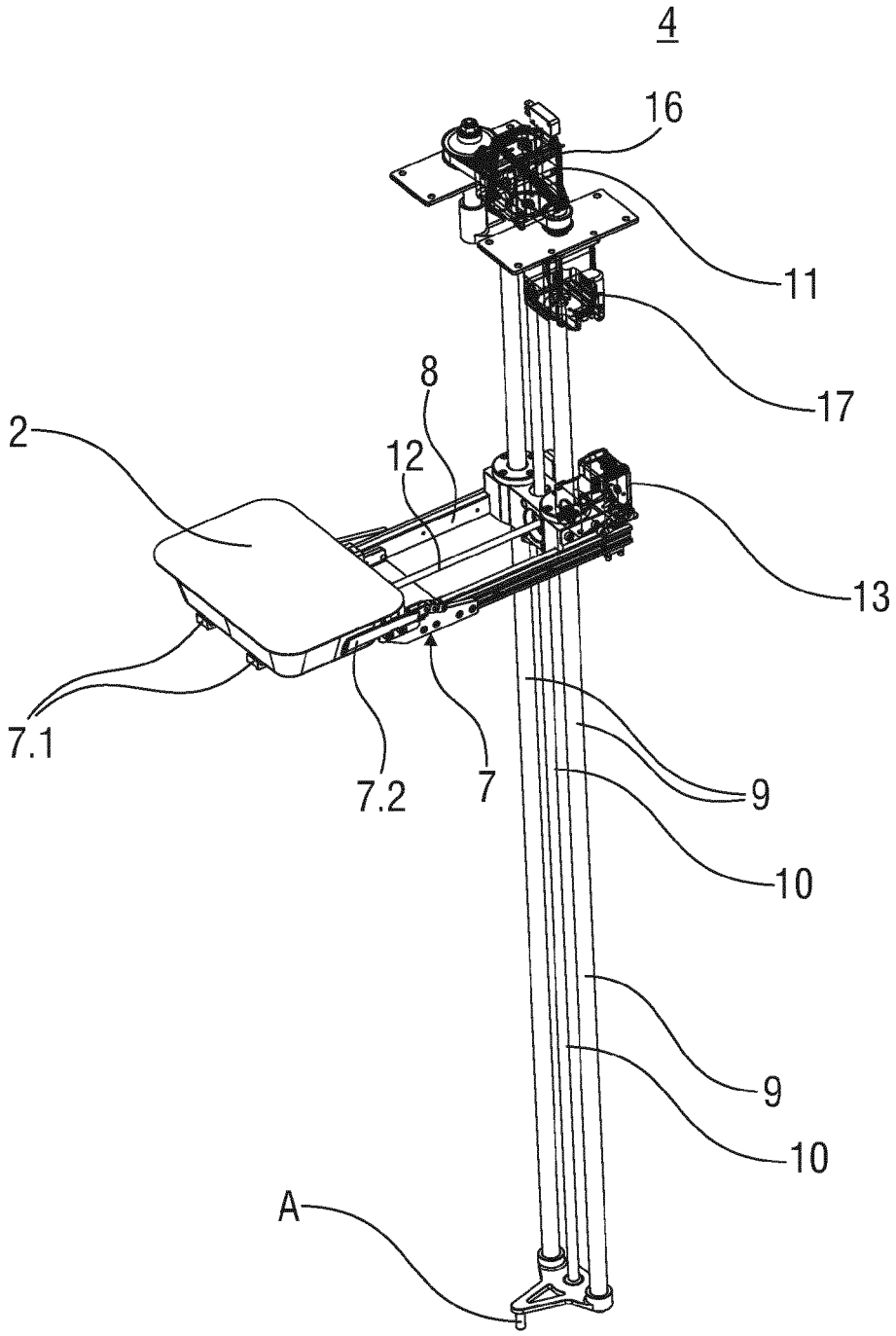
FIG. 11 schematically shows a perspective representation of a transport device of a vending machine.
Figure 12:
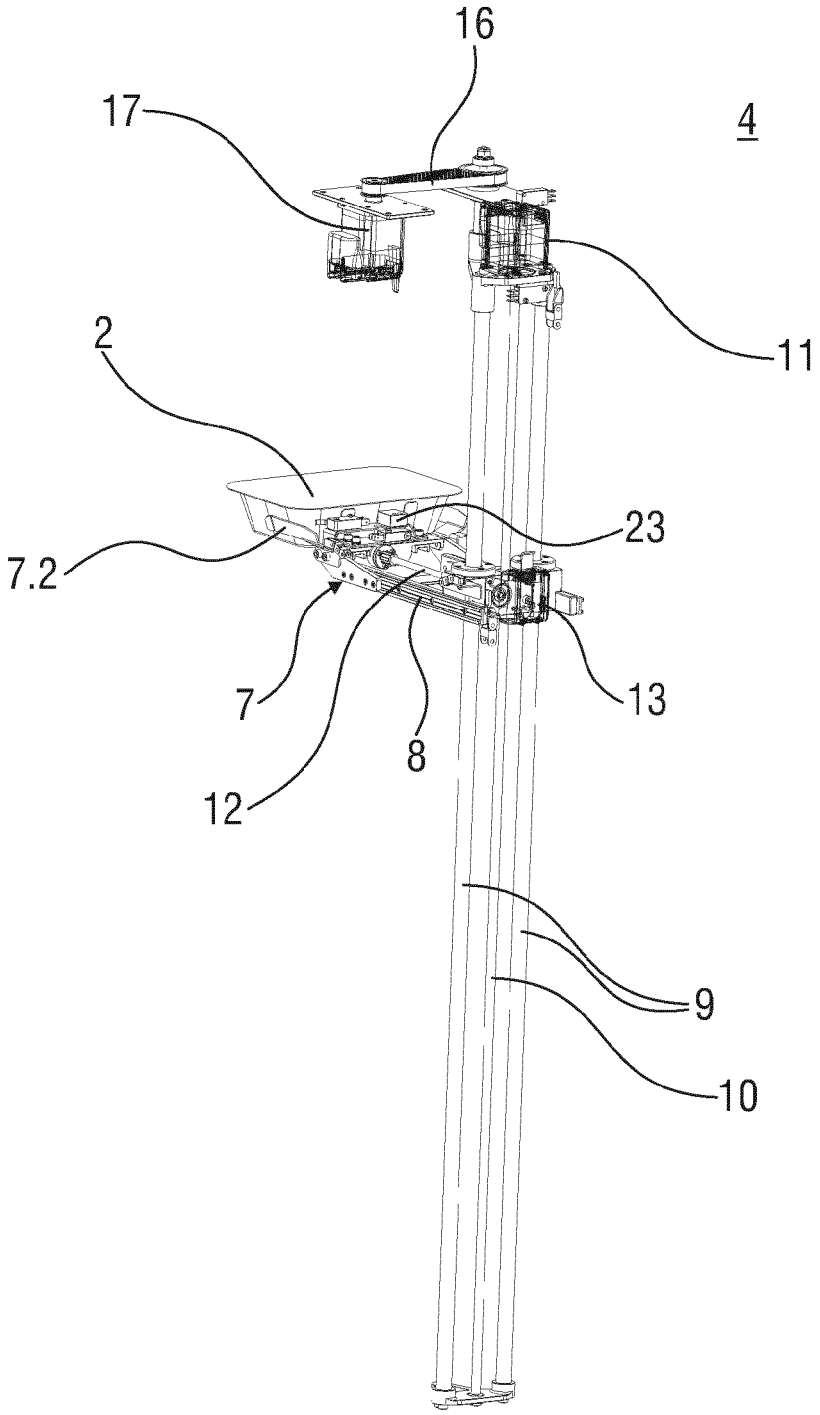
FIG. 12 schematically shows another perspective representation of a transport device of a vending machine.

Transport device 4, which is illustrated in greater detail in FIGS. 4 and 5 as well as FIGS. 11 and 12, with the aid of which food products 2 may be removed from rack storage compartment 3 and transported to stations S1, S2, 33, S4, has a transport tool 7 for gripping food product 2, which is movable horizontally and vertically. Transport tool 7, which is illustrated in greater detail in FIGS. 9 and 10, is designed in the example illustrated herein as a kind of fork having tines 7.1 and two side supports 7.2 for securely picking up and securely transporting food products 2.

To move transport tool 7 vertically, the latter is disposed on a vertical linkage 9 of transport device 4 with the aid of a horizontal bracket 8. In the example illustrated herein, this vertical linkage 9 is formed from two vertical rods, along which horizontal bracket 8 of transport tool 7 is able to slide vertically.

With the aid of a vertical threaded rod 10, which is coupled with a first electric motor 11 on one end, transport tool 7 may be raised and lowered vertically, depending on the direction of rotation of vertical threaded rod 10. A rotary motion of vertical threaded rod 10 driven by first electric motor 11 is transmitted via the thread thereof to horizontal bracket 8 of transport tool 7, the rotary motion of vertical threaded rod 10 being translated into a vertical motion of transport tool 7.

First electric motor 11, which in the example illustrated herein is coupled directly with vertical threaded rod 10, is preferably designed as a servomotor or step motor, so that a precise vertical positioning of transport tool 7 is facilitated by correspondingly activating first electric motor 11. In other embodiments, which are not illustrated herein, first electric motor 11 may also be coupled with vertical threaded rod 10 via a gear, for example via a belt or chain drive or via a toothed gear. Moreover, other types of drives for the vertical movement of transport tool 7 are also possible, for example a pneumatic or hydraulic drive.

To move transport tool 7 horizontally, the latter is coupled with a horizontal threaded rod 12, which is coupled with a second electric motor 13 on one end. Transport tool 7 may be moved horizontally along its horizontal bracket 8 by rotating horizontal threaded rod 12, the rotary motion of horizontal threaded rod 12 being transmitted in this case via the thread thereof to transport tool 7. Due to the sliding of transport tool 7 along horizontal bracket 8 during the horizontal movement, transport tool 7 may also execute, for example, curve motions in the vertical direction, i.e., it may be tilted, for example, in the vertical direction, according to a guide path predetermined by horizontal bracket 8, so that tines 7.1 may be placed under food product 2 and pushed horizontally under food product 2 until food product 2 rests securely on transport tool 7.

In this case as well, similarly to vertical threaded rod 10, second electric motor 13, which in the example illustrated herein is coupled directly with horizontal threaded rod 12, is preferably designed as a servomotor or step motor, so that a precise horizontal positioning of transport tool 7 is facilitated by correspondingly activating second electric motor 13, to be able to grip particular food product 2, remove it from rack storage compartment 3, position it precisely on particular station S1, S2, S3, S4 and also remove it again from stations S1, S2, 53, S4. In other embodiments, which are not illustrated herein, this second electric motor 13 may also be coupled with horizontal threaded rod 12 via a gear, for example via a belt or chain drive or via a toothed gear. Moreover, other types of drives for the horizontal movement of transport tool 7 are also possible, for example a pneumatic or hydraulic drive.

In the example illustrated herein, rack storage compartment 3 is formed from individual storage elements 14, which are disposed above each other on multiple levels, a plurality of storage elements 14 being disposed in a circular configuration on each level. In the example illustrated herein, two storage elements 14 of this type are furthermore disposed at third station S3 of vending machine 1, for the purpose of temporarily storing food product 2 there and keeping it warm. A storage element 14 of this type is illustrated in greater detail in FIG. 8.

In this example, storage elements 14 have two flexibly supported stoppers 15 to secure particular food product 2 in storage element 14 against sliding out, in particular in the direction of a middle region of rack storage compartment 3. To remove food product 2 from one of these storage elements 14 with the aid of transport tool 7, tines 7.1 of transport tool 7 are to be placed over these stoppers 15, i.e., between stoppers 15 and food product 2, so that food product 2 may be picked up with the aid of transport tool 7 and removed from particular storage element 14.

The arrangement of storage elements 14 for forming rack storage compartment 3 is illustrated in greater detail in FIGS. 2 and 4 through 6, not all storage elements 14 being illustrated herein for the sake of clarity. Due to the circular arrangement of storage elements 14, these elements support each other laterally. Storage elements 14 stacked above each other are designed in such a way that they engage with each other at least in a form-locked manner, i.e., storage elements 14 have tabs 14.1 on an underside and indentations 14.2 on an upper side, so that, when storage elements 14 are stacked above each other, tabs 14.1 of an upper storage element 14 engage with indentations 14.2 of a storage element 14 disposed thereunder. In this manner, a stable rack storage compartment 3 is provided by storage elements 14 in vending machine 1. Storage elements 14 of this type may be used in vending machines 1 of different designs, which have, in particular, a different installation space height available for rack storage compartment 3, since rack storage compartment 3 in particular vending machine 1 may be easily created with the aid of storage elements 14, by correspondingly stacking storage elements 14 and placing them side by side. A stack height may be adapted to an available installation space height. In other embodiments, storage elements 14 may be alternatively or additionally fastened to each other in a force-fit or integral manner, or rack storage compartment 3 may be designed in another manner.

Due to the circular arrangement of storage elements 14, a space forms in the middle region of rack storage compartment 3, in which transport device 4 is disposed, i.e., the latter is surrounded laterally by rack storage compartment 3 and projects upward in the direction of stations S1, S2, 33, S4 and out of rack storage compartment 3, to be able to transport food products 2 out of rack storage compartment 3 to stations S1, S2, S3, S4. To make optimum use of the space in the middle region of rack storage compartment 3, in the example illustrated herein, vertical linkage 9 of transport device 4 is disposed eccentrically in this middle region.

Vertical linkage 9 as well as vertical threaded rod 10 are rotatably supported, whereby they are rotatable around an axis A, which is positioned centrically in this middle region of rack storage compartment 3, as illustrated in FIG. 4. As a result, transport tool 7 is rotatable or pivotable around this axis A or around a virtual vertical extension of this axis A, so that all storage positions of rack storage compartment 3 may be reached with the aid of transport tool 7 by rotating or pivoting the latter as well as by means of vertical and horizontal movements. Vertical linkage 9, together with vertical threaded rod 10, is coupled with a third electric motor 17, which is fastened in an upper region of vending machine 1, with the aid of a belt or chain drive 16. With the aid of third electric motor 17, vertical linkage 9, together with vertical threaded rod 10, may be moved thereby along a horizontal circular path in the middle region of rack storage compartment 3 in the direct vicinity of insides of storage elements 14, circling around rotation axis A or its virtual vertical extension.

Due to the eccentric arrangement of vertical linkage 9, together with vertical threaded rod 10, in the middle region of rack storage compartment 3, it moves near an inner edge of rack storage compartment 3, i.e., near storage elements 14, during the rotary motions. As a result, nearly all the space in the middle region of rack storage compartment 3 may be used for moving transport tool 7, a diameter of the middle region having to be only slightly larger than a length of non-vertically extended transport tool 7. In this manner, it is possible to achieve the smallest possible vertical extension of vending machine 1, whereby space requirements for setting it up and a necessary footprint are relatively small.

In other embodiments, which are not illustrated herein, vertical linkage 9 and vertical threaded rod 10 may, however, also be disposed essentially centrically in the middle region of rack storage compartment 3. This then requires a larger space, whose diameter must be approximately twice the length of non-vertically extended transport tool 7, in order for the latter to pivot freely. However, if a rack storage compartment 3 having a larger number of food products 2 is provided on one level, for example, both the diameter of rack storage compartment 3 and the inner diameter of the middle region of rack storage compartment 3 increase, while the size of food products 2 and storage elements 14 needed for this purpose remains the same, so that a sufficient amount of space is also available for a centric arrangement of vertical linkage 9 and vertical threaded rod 10 of transport device 4.

In another embodiment, which is not illustrated herein, transport device 4 may also be disposed on an outside of rack storage compartment 3. In this case, rack storage compartment 3 may advantageously also rotate automatically, so that in this embodiment as well, an access of transport tool 7 to all food products 2 stored in rack storage compartment 3 is facilitated. Alternatively, transport tool 7 would have to pivot around rack storage compartment 3 along an outside of rack storage compartment 3, which, however, would be significantly more complicated to implement and would require more space for vending machine 1.

In the example illustrated herein, rack storage compartment 3 also has a rotatable design. However, it is not automatically rotatable, i.e., it is not coupled with a drive unit but is only rotatably supported, as illustrated in greater detail in FIG. 7. For this purpose, storage units 14 are disposed on a round platform 18, which has rollers 19 on an underside. This rotatable supporting of rack storage compartment 3 facilitates easy manual filling of rack storage compartment 3 with food products 2, using an opening in a housing 21 of vending machine 1, which is provided on the side of vending machine 1 and is sealed by a door 20.

Figure 6:
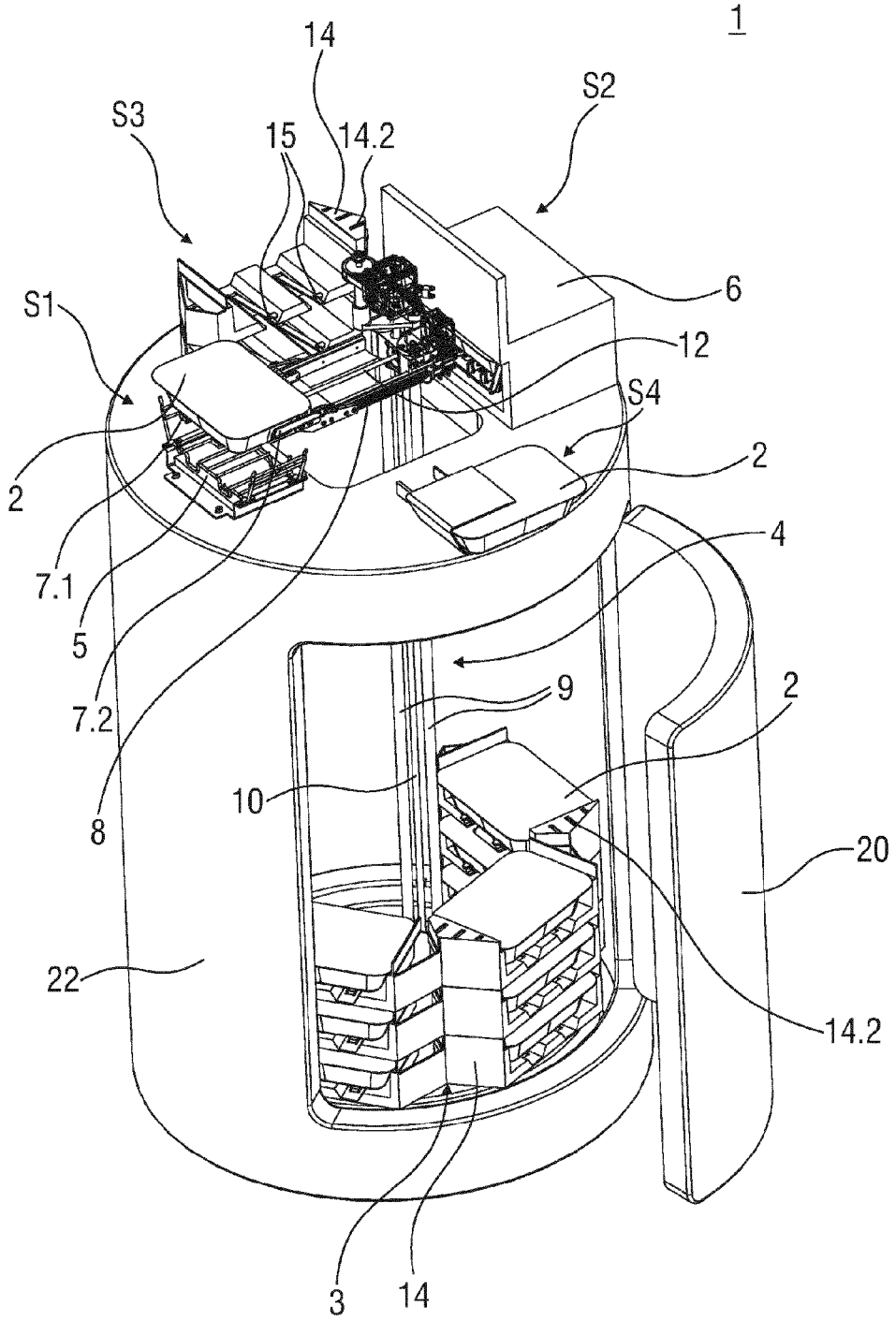
FIG. 6 schematically shows another perspective representation of a vending machine.
Figure 7:
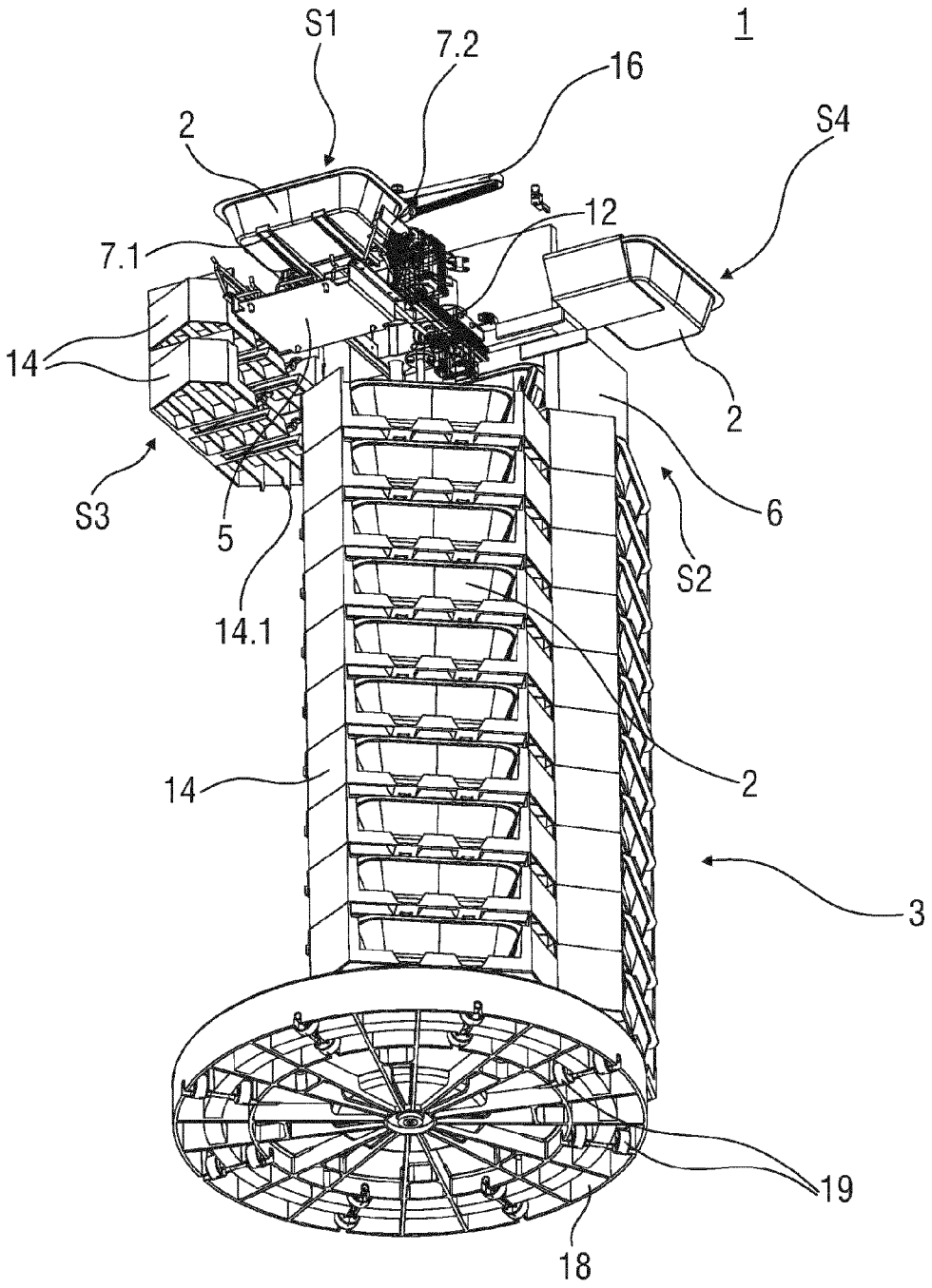
FIG. 7 schematically shows another perspective representation of internal components of a vending machine.
Figure 8:
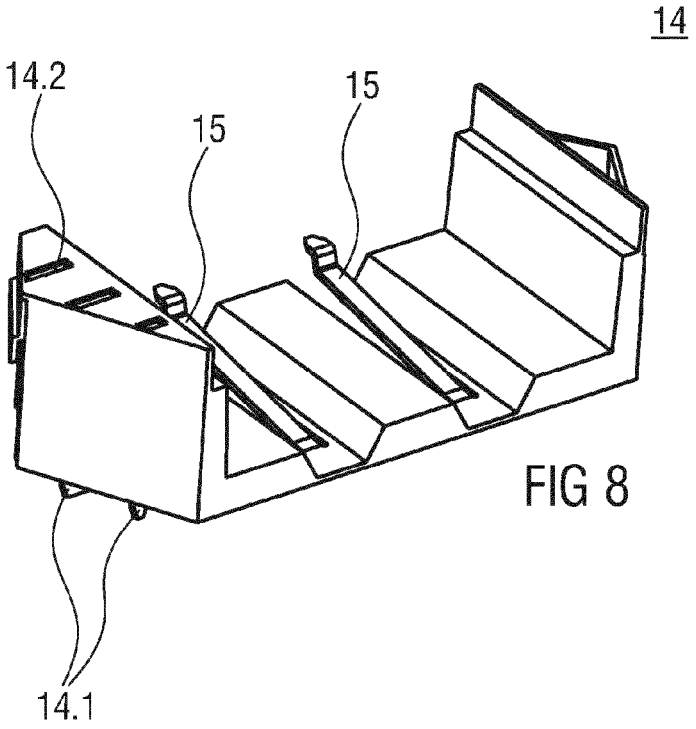
FIG. 8 schematically shows a perspective representation of a storage element of a rack storage compartment of a vending machine.

This door 20 must be opened for manual filling, as illustrated in FIGS. 1 and 6, and rack storage compartment 2 must be manually rotated to be able to fill all storage position of rack storage compartment 3 with food products 2. During a normal automatic operation of vending machine 1, rack storage compartment 3 must be blocked in a fixed position, so that a rotation and thus a change in position of food products 2 stored in rack storage compartment 3 is prevented. For this purpose, as shown in FIG. 1, door 20 has a formation 22 on an inside, which faces rack storage compartment 3 and which is disposed in a space between two stacks of storage elements 14 when door 20 is closed and thereby blocks a rotation of rack storage compartment 3.

Due to this design of rack storage compartment 3, each stocked food product 2 is assigned a fixed storage position, which must be uniquely identified and therefore controlled by transport tool 7 to remove particular food product 2. As a result, a dynamic stocking in vending machine 1 is facilitated, which is also referred to as random stocking. In other words, a large number of different food products 2 must be sorted into random storage positions in rack storage compartment 3, it being necessary to uniquely identify and store particular food product 2 and its storage position in rack storage compartment 3. When the consumer makes a corresponding selection of food product 2, the latter must be removed from rack storage compartment 3 with the aid of transport tool 7, which approaches its storage position in rack storage compartment 3, and transported to particular station S1, S2, S3, S4 in vending machine 1.

Food product 2 may be sorted into rack storage compartment 3, for example, as described above, manually or automatically, it being necessary to identify and store each food product 2 and its storage position in rack storage compartment 3. Automatic sorting may take place, for example with the aid of transport tool 7, which picks up food product 2 to be stored in rack storage compartment 3, for example at fourth station S4 or at another accessible location in vending machine 1 and automatically stocks it in rack storage compartment 3.

This dynamic or random storage of food products 2 avoids, in particular, incorrect filling of rack storage compartment 3, since it is not necessary to sort different types of food products 2 into permanently predetermined storage positions for the particular type. In a fixed-position storage approach of this type, incorrectly sorted food products 2 could result in an incorrect food product 2 not selected by the consumer to be dispensed. This is prevented by the dynamic or random stocking.

Moreover, since it is necessary to identify stocked food products 2, it is possible to easily monitor the inventory. This enables rack storage compartment 3 to be refilled in good time when one or multiple types of food products 2 is/are reduced, so that an availability of food products 2 may be easily optimized. A quantity of different food products 2 may thus also be adapted to their particular demand, since no fixed storage positions for different types of food products 2 are reserved, but instead food products 2 may be sorted into all available storage locations. In other words, different types of food products 2 are to be stocked in different quantities, depending on their demand, so that an existing storage location in rack storage compartment 3 may be optimally used, whereby intervals between refilling rack storage compartment 3 may be prolonged, and rack storage compartment 3 and thus vending machine 1 may have a smaller design.

Grill 5, which is disposed at first station S1 of vending machine 1 for preparing food products 2, advantageously has at least one resistance wire heating device, in which one or multiple resistance wire(s) is/are disposed in an unenclosed manner. In other words, this is not a so-called quartz grill, in which the heating wires are enclosed by quartz glass and surrounded by gas.

This design of grill 5 with the aid of the resistance wire heating device permits the emission of thermal radiation, in particular infrared radiation, having a greater wavelength than in a quartz grill. The wavelength of the radiation in this grill 5 having exposed resistance wires is, for example, approximately 2.8 μm to 3.8 μm, while it is approximately 1.1 μm in a quartz grill. This greater wavelength makes it possible to prepare food product 2, i.e., to heat it, even in the packaged state, since longer-wave radiation penetrates the packaging and acts upon food product 2. In the exemplary embodiment illustrated in the figures, food products 2 are each packaged in food product packaging and remain therein until they are dispensed to the consumer, i.e., the packaging is not removed even for preparation.

With the aid of a grill 5 having resistance wires, which are disposed, for example, over a wide area and evenly on grill 5 and cover an area corresponding to an extension of food product 2, a much more directed radiation emission is also possible than in a quartz grill, in which the radiation emission takes place in all directions from the quartz glass tubes. The resistance wire heating device or a plurality thereof is/are disposed and designed in such a way, for example, that an irradiation of food product 2 from below and/or from above and/or from the side is possible. Grill 5 may also be designed in the form of an oven, i.e., it may have a partially or completed closed or closable cooking space.

Moreover, vending machine 1 preferably includes a perforation unit, which is not illustrated in greater detail herein, for introducing at least one hole or a plurality of holes into the packaging of food product 2 prior to the preparation thereof. The perforation unit has, for example, one or multiple needle-like elements, which are disposed in an upper region of vending machine 1 and are oriented downwards, so that while food product 2 is being lifted out of rack storage compartment 3 with the aid of transport tool 7, the packaging is to be perforated by being additionally lifted in the direction of the perforation unit and then lowered slightly and transported to one of stations S1, S2, S3, S4 for further processing.

Due to this perforation, it is possible for fluids, in particular steam, to escape from the packaging while food product 2 is being heated and for the destruction of the packaging due to too much internal pressure to be prevented. In this manner, it is not necessary to open the packaging all the way to prepare food product 2, so that the latter remains hygienically packaged. However, vending machine 1 may also alternatively have an opening mechanism for opening the packaging and, if necessary, possibly for removing food product 2 from the packaging for the purpose of preparing and repackaging food product 2. However, this would be associated with increased complexity.

A cooling device, which is not illustrated in further detail herein, is advantageously disposed on an upper side of rack storage compartment 3. Food products 2 are to be cooled with the aid of this cooling device and thereby stored for a much longer period of time. By disposing the cooling device on the upper side of rack storage compartment 3, the cooling is particularly efficient, since air cooled with the aid of the cooling device sinks in the direction of rack storage compartment 3, so the rack storage compartment 3 is placed in a pool of cold air generated by the cooling device and enclosed by housing 21 of vending machine 1 or an additional envelope of rack storage compartment 3.

In an arrangement on the upper side of rack storage compartment 3, the cooling device is designed and disposed in such a way that food products 2 are to be transported from rack storage compartment 3, past the cooling device to individual stations S1, S2, S3, S4 of vending machine 1, with the aid of transport device 4, i.e., for example in a circular configuration with an opening in the middle, through which transport device 4 is passed and through which food products 2 are to be transported from rack storage compartment 3 with the aid of transport tool 7. In other embodiments of vending machine 1, however, the cooling device may be disposed in a different position, for example it may be at least partially surrounded by rack storage compartment 3, or it may at least partially surround rack storage compartment 3, for example on the side, or it may be disposed on an underside of rack storage compartment 3.

Vending machine 1 includes at least one identification device 23 for identifying food products 2. In the embodiment illustrated herein, this identification device 23 is, for example, a bar code reader which is disposed on transport tool 7 and reads a bar code printed on the packaging of food product 2. This approach is useful, in particular if rack storage compartment 3 is automatically filled with food products 2 with the aid of transport tool 7, since food product 2 is to be identified using the bar code reader, and its identity, together with the storage position in which food product 2 is place by transport tool 7, may be stored. When the consumer selects food product 2, the latter may be removed again from rack storage compartment 3 by approaching the appropriate storage position with the aid of transport tool 7.

However, identification device 23 situated on transport tool 7 is useful even if rack storage compartment 3 is filled manually. For example, after rack storage compartment 3 is filled and locked with the aid of door 20, all storage positions, or at least all newly filled storage positions, are to be approached with the aid of transport tool 7, and stocked food products 2 uniquely identified and their storage positions stored with the aid of the bar code reader by reading the bar code printed on the packaging. The storage position is to be determined by orienting transport tool 7 during recording of the bar code of particular food product 2. In this manner, a fast and efficient manual filling of rack storage compartment 3 is to be implemented, food products 2 and their storage positions are to be recorded and stored without laborious manual work during sorting.

Alternatively to the bar code reader, identification device 23 may also be designed as a reader for reading a transponder on food product 2 or its packaging. The transponder is, for example, a so-called RFID (radio frequency identification) chip.

In another preferred embodiment, identification device 23 is an optical recording unit, for example a camera. It is also possible to use multiple identification devices 23, for example to ensure a reliable identification of food product 2 at any time. In this manner, food products 2 which may be identified in different ways, i.e., for example if they do not have a bar code or a transponder, may be processed by this vending machine 1.

As a result, particular food product 2 may be easily identified and handled by vending machine 1 on the basis of the transponder or on the basis of a bar code on the packaging or on the basis of the packaging itself or its label, i.e., for example prepared at a temperature adjusted to particular food product 2 and cooking time in grill 5 and/or microwave 6, and/or cooled and/or stored at an appropriately adjusted temperature.

An item of transponder information or the label on the packaging, for example the bar code, may furthermore contain, for example a sell-by date for particular food product 2, so that a flawless condition of food product 2 to be dispensed to the consumer is ensured at all times. For identification with the aid of a camera, for example, a second, much larger bar code may be printed on the packaging, while a standard bar code remains printed on the packaging as information for a payment system.

By using multiple identification devices 23 designed as cameras at different positions in vending machine 1, it is furthermore possible, for example, to check and monitor an optimum positioning of particular food product 2 in rack storage compartment 3 and/or on transport tool 7 and/or in stations S1, S2, S3, S4 and/or a particular condition of food product 2. For example it is possible to assess a current cooked status of food product 2 with the aid of a camera in the region of grill 5 and/or microwave 6. A camera in rack storage compartment 3 may be used to monitor the stock therein and assess the state of its quality.

Vending machine 1 preferably includes at least one touch-sensitive display unit, which is not illustrated in greater detail herein, i.e., for example a so-called touch screen display. This gives the consumer an easy and comfortable means of communication between the consumer and vending machine 1. With the aid of the touch-sensitive display unit, for example, food product 2 is selectable by the consumer, and a time remaining until food product 2 is finished and dispensed may be displayed to the consumer by vending machine 1. For example, vending machine 1 may furthermore also be programmed via this touch-sensitive display unit, i.e., for example, food products 2 to be processed may be specified, and storage times and/or temperatures as well as preparation times and/or temperatures may be assigned to them.

In one advantageous embodiment, vending machine 1 preferably has at least one payment unit, which enables the consumer to pay for food product 2. These payment units are, for example a cash payment unit and/or a payment unit for prepaid cards and/or credit cards.

Moreover, vending machine 1 advantageously has at least one wired and/or wireless communication unit. This communication unit makes it possible, for example, to check a particular means of payment, for example the prepaid card or credit card of the consumer, to ensure the consumer's ability to pay. A communication unit of this type furthermore facilitates, for example, a remote data transmission for maintenance and control of vending machine 1, so that, for example, malfunctions may be identified immediately and possibly corrected with the aid of remote data transmission. It is also possible, for example, to check a current fill state of rack storage compartment 3 in this manner, so that it may be refilled in good time.

A remote ordering of food products 2 with the aid of remote data transmission is furthermore facilitated by this communication unit, so that the consumer may select and order a food product 2 from a greater distance, for example from home, which may then be prepared by vending machine 1 while the consumer makes his way to vending machine 1 to pick up food product 2. Long waiting times for the consumer at vending machine 1 while ordered food product 2 is being prepared are prevented in this manner. For example, the consumer may also be notified via this communication unit of when his food product 2 is finished and ready for dispensing, so that he can pick it up in good time. If the consumer is late in picking up food product 2, the latter is temporarily stored and kept warm in station S3.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A vending machine in which at least one food product is storable, coolable and/or heatable, the vending machine comprising:

a rack storage compartment adapted to store a plurality of food products;

a transport device via which one particular food product is adapted to be removed from the rack storage compartment, the transport device having a transport tool for gripping the food product and is movable at least horizontally and vertically and is rotatable and/or pivotable at least around a vertical axis, the transport device being arranged centrally within the rack storage compartment, and the food product being transportable by the transport tool of the transport device to each of a plurality of stations arranged in the vending machine, the plurality of stations being arranged above the rack storage compartment, wherein the rack storage compartment has storage locations for food products on a plurality of levels disposed above each other, the storage locations on each level together forming a circle storage location formation, wherein the transport device is arranged centrally within the storage location formation.

2. The vending machine according to claim 1, wherein the rack storage compartment is rotatably supported.

3. The vending machine according to claim 1, wherein a vertical linkage of the transport device, on which the transport tool is disposed directly or via a horizontal bracket and along which it is movable vertically, is at least partially surrounded by the rack storage compartment such that the vertical linkage is disposed centrally in the rack storage compartment.

4. The vending machine according to claim 1, further comprising a grill for at least partially preparing the food product, the grill having at least one resistance wire heating device, in which one or multiple resistance wires are disposed in an unenclosed manner.

5. The vending machine according to claim 1, further comprising a perforation unit for introducing at least one hole into a packaging of the food product prior to the preparation thereof.

6. The vending machine according to claim 1, further comprising a cooling device arranged on an upper side of the rack storage compartment.

7. The vending machine according to claim 1, further comprising at least one identification device for identifying the food product.

8. The vending machine according to claim 1, further comprising at least one camera.

9. The vending machine according to claim 1, further comprising at least one touch-sensitive display unit.

10. The vending machine according to claim 1, further comprising at least one payment unit.

11. The vending machine according to claim 1, further comprising at least one wired and/or wireless communication unit.

12. A method for operating a vending machine, the vending machine comprising a rack storage compartment adapted to store a plurality of food products, a transport device via which one particular food product is adapted to be removed from the rack storage compartment, the transport device having a transport tool for gripping the food product and being movable at least horizontally and vertically and is rotatable and/or pivotable at least around a vertical axis, the transport device being arranged centrally within the rack storage compartment, the food product being transportable by the transport tool of the transport device to each of a plurality of stations arranged in the vending machine, the plurality of stations being arranged above the rack storage compartment, the rack storage compartment having storage locations for food products on a plurality of levels disposed above each other, the storage locations on each level together forming a circle storage location formation, and the transport device being arranged centrally within the storage location formation, the method comprising:

removing at least one food product from the rack storage compartment via the transport device, which is arranged centrally within the storage location formation of the rack storage compartment; and transporting the food product to at least one of the plurality of stations in the vending machine, which are disposed above the rack storage compartment, the transport tool of the transport device being moved at least horizontally and vertically and rotated and/or pivoted at least around the vertical axis for the purpose of approaching a storage position of the food product and gripping and transporting the food product, wherein the food product is transportable by the transport tool of the transport device to each of the plurality of stations arranged in the vending machine.

13. The method according to claim 12, wherein the rack storage compartment is rotated around a vertical rotation axis to approach a storage position of the food product with the aid of the transport tool and to grip and transport the food product.

14. A vending machine in which at least one food product is storable, coolable and/or heatable, the vending machine comprising:

a rack storage compartment adapted to store a plurality of food products;

a transport device via which one particular food product is adapted to be removed from the rack storage compartment, the transport device having a transport tool for gripping the food product and is movable at least horizontally and vertically and is rotatable and/or pivotable at least around a vertical axis, the transport device being arranged centrally within the rack storage compartment, and the food product being transportable by the transport tool of the transport device to each of a plurality of stations arranged in the vending machine, the plurality of stations being arranged above the rack storage compartment, wherein the transport tool includes side supports and support tines to grip and transport the food product.

15. The vending machine according to claim 14, wherein each food product is retained in a respective individual storage element of the rack storage compartment, and each individual storage element has flexible stoppers the engage with the support tines of the transport tool to release the food product from the individual storage element for transport by the transport tool.

* * * * *